US011765517B2

(12) United States Patent
Shao et al.

(10) Patent No.: US 11,765,517 B2
(45) Date of Patent: Sep. 19, 2023

(54) SOUND PRODUCTION UNIT AND SPEAKER

(71) Applicant: AAC Microtech (Changzhou) Co., Ltd., Changzhou (CN)

(72) Inventors: Tao Shao, Shenzhen (CN); Xudong Yan, Shenzhen (CN); Xiaojiang Gu, Shenzhen (CN)

(73) Assignee: AAC Microtech (Changzhou) Co., Ltd., Changzhou (CN)

( * ) Notice: Subject to any disclaimer, the term of this patent is extended or adjusted under 35 U.S.C. 154(b) by 0 days.

(21) Appl. No.: 17/833,751

(22) Filed: Jun. 6, 2022

(65) Prior Publication Data

US 2023/0199398 A1 Jun. 22, 2023

(30) Foreign Application Priority Data

Dec. 21, 2021 (CN) ..... 202111570259.6

(51) Int. Cl.

| | |
|---|---|
| ***H04R 9/06*** | (2006.01) |
| ***H04R 1/02*** | (2006.01) |
| ***H04R 1/28*** | (2006.01) |
| ***H04R 7/12*** | (2006.01) |
| ***H04R 9/02*** | (2006.01) |

(52) U.S. Cl.

CPC ..... *H04R 9/06* (2013.01); *H04R 1/026* (2013.01); *H04R 1/2811* (2013.01); *H04R 7/12* (2013.01); *H04R 9/027* (2013.01); *H04R 2400/11* (2013.01); *H04R 2499/10* (2013.01)

(58) Field of Classification Search

CPC . H04R 7/12; H04R 9/06; H04R 9/027; H04R 1/026

See application file for complete search history.

(56) References Cited

FOREIGN PATENT DOCUMENTS

WO WO-2022062047 A1 * 3/2022

* cited by examiner

*Primary Examiner* — Sunita Joshi
(74) *Attorney, Agent, or Firm* — W&G Law Group

(57) ABSTRACT

The present application relates to a sound production unit and a speaker. The sound production unit includes: a frame, where the frame has a receiving space; a magnetic path system, where the magnetic path system is arranged in the receiving space, and a magnetic gap is formed in the magnetic path system; a vibration system, where the vibration system includes a first diaphragm and a second, a first voice coil assembly inserted into the magnetic gap to drive the first diaphragm to vibrate to produce a sound, and a second voice coil assembly inserted into the magnetic gap to drive the second diaphragm to vibrate to produce a sound; and an end cover. Vibrations of the sound production unit or the speaker and the like can be counteracted; cophase stacking can also be performed on sound waves; and the acoustics effect of the speaker is enhanced.

10 Claims, 7 Drawing Sheets

SOUND PRODUCTION UNIT AND SPEAKER

TECHNICAL FIELD

The present invention relates to the technical field of electroacoustic conversion, in particular to a sound production unit and a speaker.

BACKGROUND

As an important component of a speaker with an audio playback function, a sound production unit has been widely used. The sound production unit usually includes a vibration system and a magnetic path system. The vibration system includes a diaphragm, a voice coil and a voice coil bobbin. The diaphragm and/or the voice coil are mounted through the voice coil bobbin; and a magnetic gap is formed in the magnetic path system, and the voice coil extends into the magnetic gap, so as to drive, under the action of the magnetic path system, the diaphragm to vibrate to produce a sound.

In order to adapt to the development of miniaturization and thinning of speakers, the sound production unit used therein are not only required to be miniaturized, but also required to have higher sound quality and the like. The existing sound production unit usually adopts a structure in which a single diaphragm produces sounds from a front surface. When the voice coil drives, under the action of the magnetic path system, the diaphragm to vibrate, the voice coil bobbin or other components in the sound production unit will also vibrate with it. Thus, the acoustic performance and structural stability of the sound production unit are affected, which in turn affects the working performance of the speaker.

SUMMARY

In order to overcome the above defects, the present application provides a sound production unit and a speaker, which are favorable for improving the acoustic performance and structural stability of the sound production unit.

In a first aspect, an embodiment of the present application provides a sound production unit, including: a frame, where the frame has a receiving space; a magnetic path system, where the magnetic path system is arranged in the receiving space, and a magnetic gap is formed in the magnetic path system; a vibration system, where the vibration system includes a first diaphragm and a second diaphragm which are fixedly arranged on two opposite sides of the frame, a first voice coil assembly inserted into the magnetic gap to drive the first diaphragm to vibrate to produce a sound, and a second voice coil assembly inserted into the magnetic gap to drive the second diaphragm to vibrate to produce a sound; and an end cover, where the end cover is fixedly arranged on one side of the frame that is provided with the first diaphragm or the second diaphragm. The first diaphragm has a first through hole, and the second diaphragm has a second through hole; the first voice coil assembly has a first channel which extends along a vibrating direction of the first diaphragm or the second diaphragm, and the second voice coil assembly has a second channel which extends along the vibrating direction; the magnetic path system has a third channel which extends along the vibrating direction; and the first through hole, the first channel, the third channel, the second channel, and the second through hole are communicated in sequence.

In combination with the first aspect, in one feasible implementation, the magnetic path system includes a main magnet, and an auxiliary magnet arranged around an outer periphery of the main magnet; the main magnet and the auxiliary magnet are spaced apart from each other to form the magnetic gap; and the third channel is arranged in a manner of penetrating through the main magnet along the vibrating direction.

In combination with the first aspect, in one feasible implementation, the magnetic path system further includes a first main pole core and a second main pole core which are fixedly arranged on two opposite sides, along the vibrating direction, of the main magnet, and a first auxiliary pole core and a second auxiliary pole core which are fixedly arranged on two opposite sides, along the vibrating direction, of the auxiliary magnet; the first auxiliary pole core is arranged around an outer periphery of the first main pole core; the second auxiliary pole core is arranged around an outer periphery of the first main pole core; the first main pole core is provided, in a penetrating manner along the vibrating direction, with a third through hole communicated with the first channel and the third channel; and the second main pole core is provided, in a penetrating manner along the vibrating direction, with a fourth through hole communicated with the second channel and the third channel.

In combination with the first aspect, in one feasible implementation, the first voice coil assembly includes a first voice coil bobbin fixedly arranged between the first diaphragm and the first main pole core, and a first voice coil arranged around an outer periphery of the first voice coil bobbin; the first channel is arranged in a manner of penetrating through the first voice coil bobbin along the vibrating direction; the second voice coil assembly includes a second voice coil bobbin fixedly arranged between the second diaphragm and the second main pole core, and a second voice coil arranged around an outer periphery of the second voice coil bobbin; the second channel is arranged in a manner of penetrating through the second voice coil bobbin along the vibrating direction; and at least part of the first voice coil and at least part of the second voice coil are inserted into the magnetic gap.

In combination with the first aspect, in one feasible implementation, the magnetic path system further includes a mounting rack; the mounting rack includes a mounting rack body and an abutment portion; the mounting rack body has a receiving chamber; the main magnet is arranged in the receiving chamber; the receiving chamber has a first opening and a second opening which are oppositely arranged; the first opening faces to the first diaphragm; the second opening faces to the second diaphragm; an inner diameter of the first opening is less than an outer diameter of the main magnet; an inner diameter of the second opening is greater than the outer diameter of the main magnet; the abutment portion extends from the second opening along a radial direction of the mounting rack body; and the abutment portion is fixedly connected to one side of the auxiliary magnet facing to the second diaphragm.

In combination with the first aspect, in one feasible implementation, the vibrating system further includes a first elastic ring and a second elastic ring which are spaced apart along the vibrating direction; the first elastic ring is connected between the first voice coil and the frame; and the second elastic ring is connected between the second voice coil and the frame.

In combination with the first aspect, in one feasible implementation, the first diaphragm includes a first vibration piece, a first suspension and a second suspension; the first through hole is formed in the first vibration piece; the first suspension is connected between an outside edge of the first vibration piece and the frame; the second suspension is connected between an inside edge of the first vibration piece and the first voice coil bobbin; and/or, the second diaphragm includes a second vibration piece, a third suspension and a fourth suspension; the second through hole is formed in the second vibration piece; the third suspension is connected between an outside edge of the second vibration piece and the frame; and the fourth suspension is connected between an inside edge of the second vibration piece and the second voice coil bobbin.

In combination with the first aspect, in one feasible implementation, the frame includes a first shell for fixing the first diaphragm and a second shell for fixing the second diaphragm; the first shell is superposed to the second shell along the vibrating direction; a supporting portion is arranged in the first shell or the second shell; and the magnetic path system is fixedly arranged to the supporting portion.

In combination with the first aspect, in one feasible implementation, a side wall of the first shell and/or a side wall of the second shell is provided with at least one mounting portion; and the mounting portion is connected to an external shell.

In a second aspect, an embodiment of the present application provides a speaker, including any one of the above sound production unit.

Compared with the related art, this technical solution at least has the following technical effects:

According to a sound production unit and a speaker provided in the embodiments of the present application, the sound production unit includes a first diaphragm and a second diaphragm which are fixedly arranged on two opposite sides of the frame. Under the action of the magnetic path system, a direction where the first voice coil assembly drives the first diaphragm to vibrate is opposite to a direction where the second voice coil assembly drives the second diaphragm to vibrate, and driving forces provided to them by the magnetic path system are the same, and can counteract the vibration of the entire sound production unit or speaker due to the vibration of the first diaphragm and/or the second diaphragm, thus achieving vibration attenuation, improving the acoustic performance and structural stability of the sound production unit and ensuring the working performance of the speaker.

In addition, the end cover is fixedly arranged on the side of the frame that is provided with the first diaphragm or the second diaphragm; the first diaphragm has the first through hole; the second diaphragm has the second through hole; the first voice coil assembly has the first channel; the second voice coil assembly has the second channel; the magnetic path system has the third channel; the first through hole, the first channel, the third channel, the second channel, and the second through hole are communicated in sequence to form a sound guide channel; therefore, sound waves produced by the first diaphragm that vibrates air flow to the side with the second diaphragm via the sound guide channel, or sound waves produced by the second diaphragm that vibrates air flow to the side with the first diaphragm via the sound guide channel, so that cophase stacking is performed on the sound waves produced by the first diaphragm that vibrates air and the sound waves produced by the second diaphragm that vibrates air, which can enhance the acoustics effect of the speaker.

It should be understood that the above general description and the following detailed description are exemplary only, and are not intended to limit the present application.

BRIEF DESCRIPTION OF THE DRAWINGS

In order to explain the technical solutions of the embodiments of the present invention more clearly, the following will briefly introduce the accompanying drawings used in the embodiments. Apparently, the drawings in the following description are only some embodiments of the present invention. Those of ordinary skill in the art can obtain other drawings based on these drawings without creative work.

REFERENCE NUMERALS IN THE DRAWINGS

Figure 1:
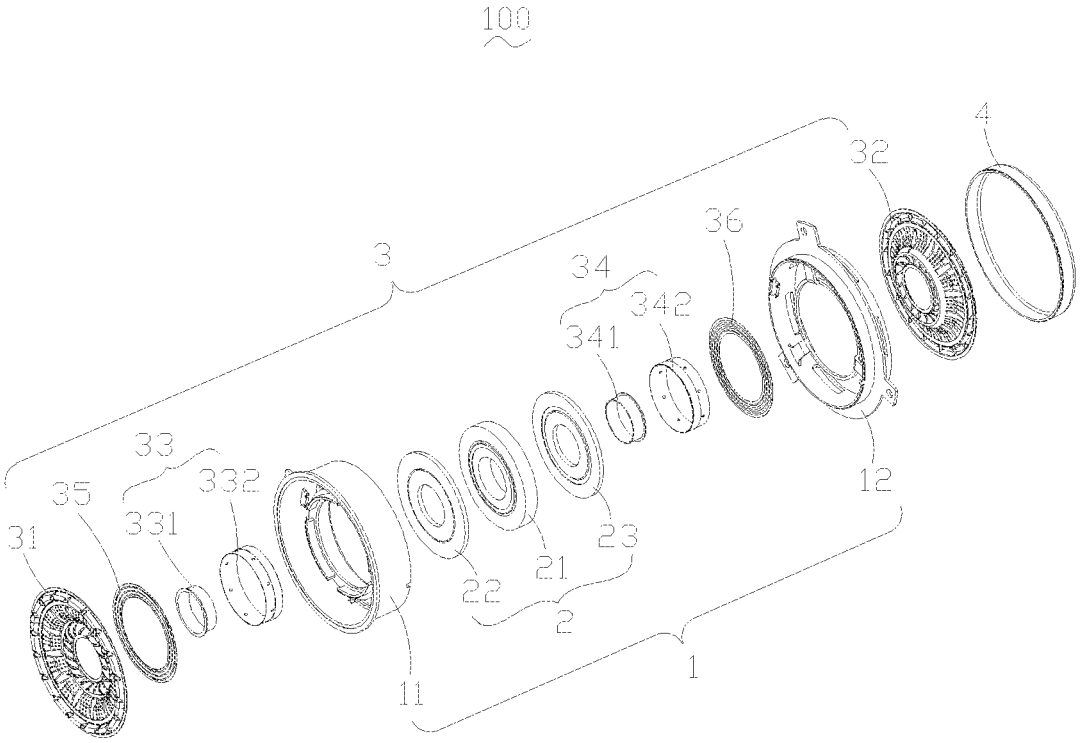
FIG. 1 is an exploded schematic structural diagram of a sound production unit provided in an embodiment of the present application.
Figure 2:
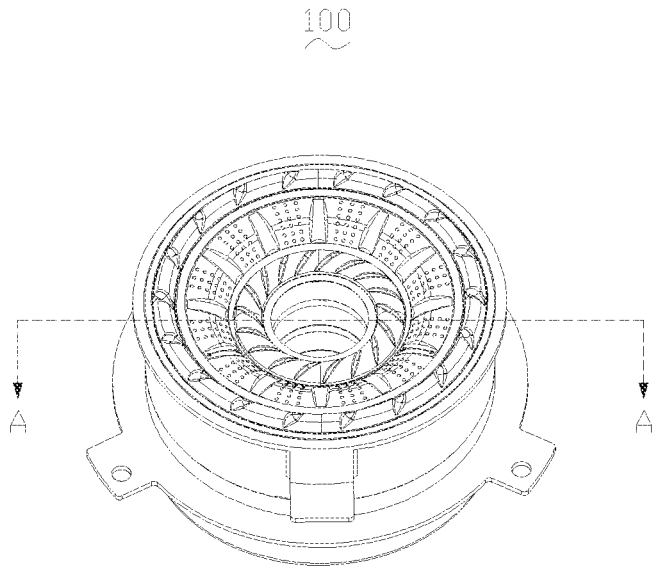
FIG. 2 is a schematic structural diagram of a sound production unit provided in an embodiment of the present application.
Figure 3:
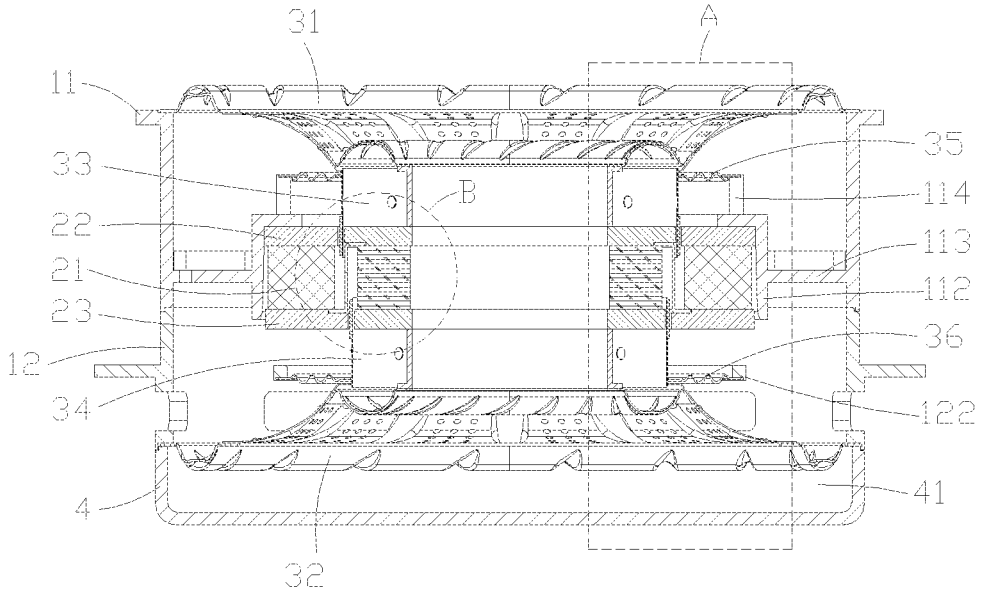
FIG. 3 is a sectional view of a sound production unit provided in an embodiment of the present application along line A-A.
Figure 4:
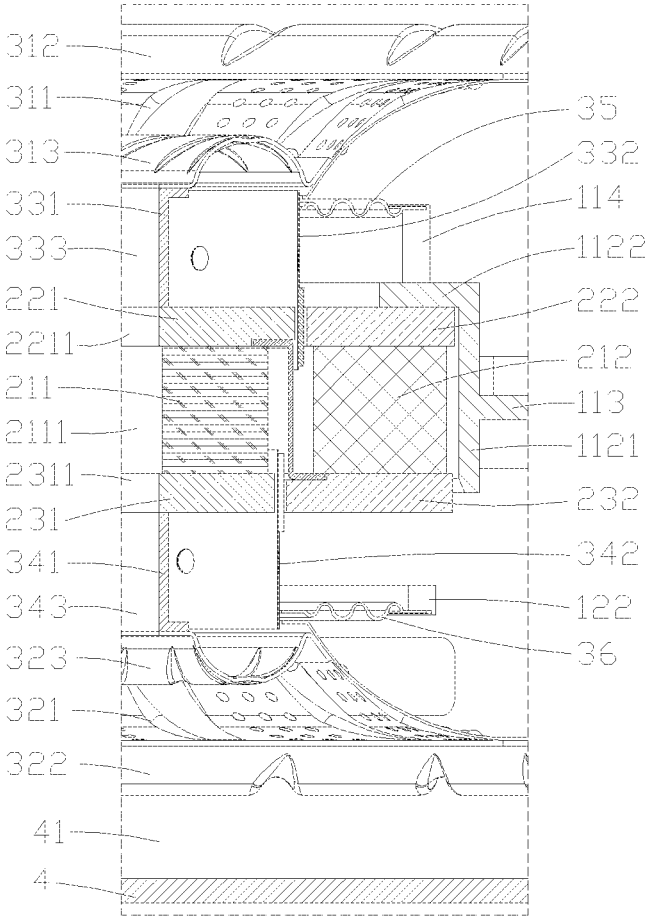
FIG. 4 is a partially enlarged schematic structural diagram of the sound production unit shown in FIG. 3 at A.
Figure 5:
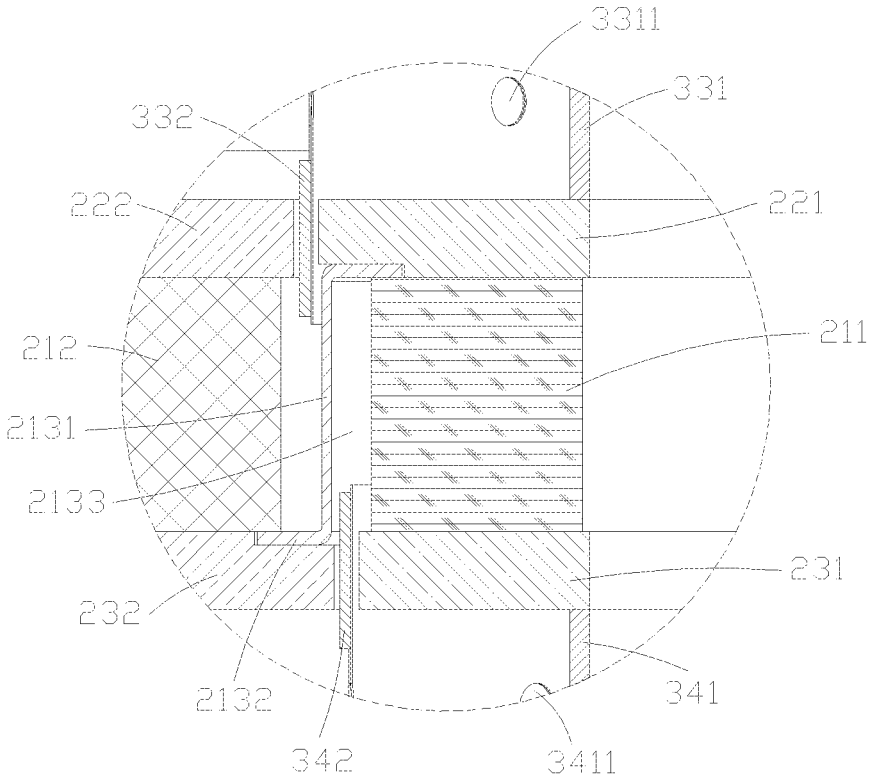
FIG. 5 is a partially enlarged schematic structural diagram of the sound production unit shown in FIG. 3 at B.
Figure 6:
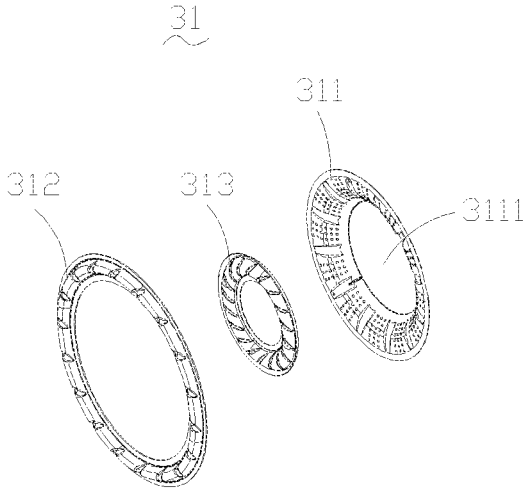
FIG. 6 is an exploded schematic structural diagram of a first diaphragm shown in FIG. 1.
Figure 7:
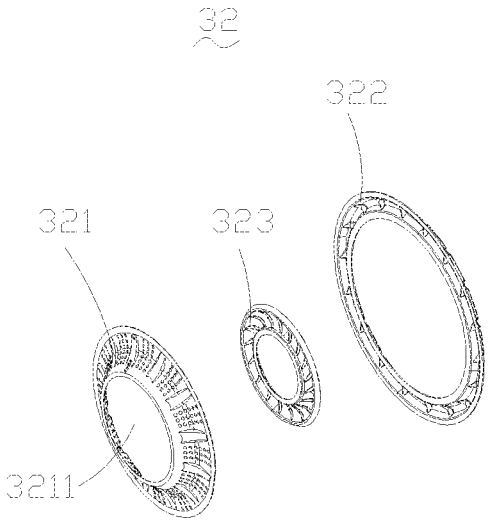
FIG. 7 is an exploded schematic structural diagram of a second diaphragm shown in FIG. 1.
Figure 8:
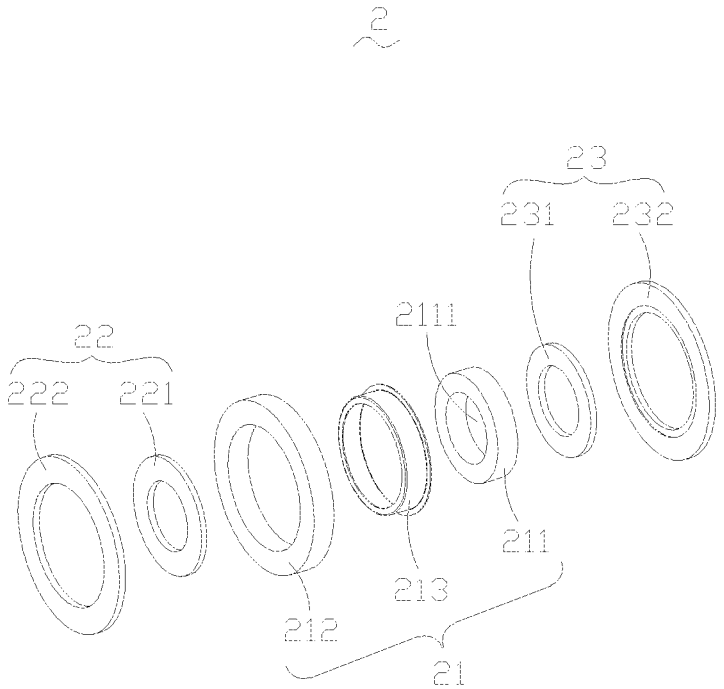
FIG. 8 is an exploded schematic structural diagram of a magnetic path system shown in FIG. 1.
Figure 9:
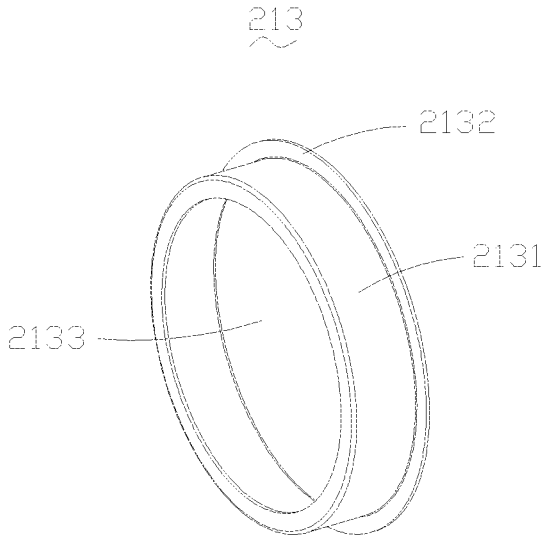
FIG. 9 is a schematic structural diagram of a mounting rack shown in FIG. 8.
Figure 10:
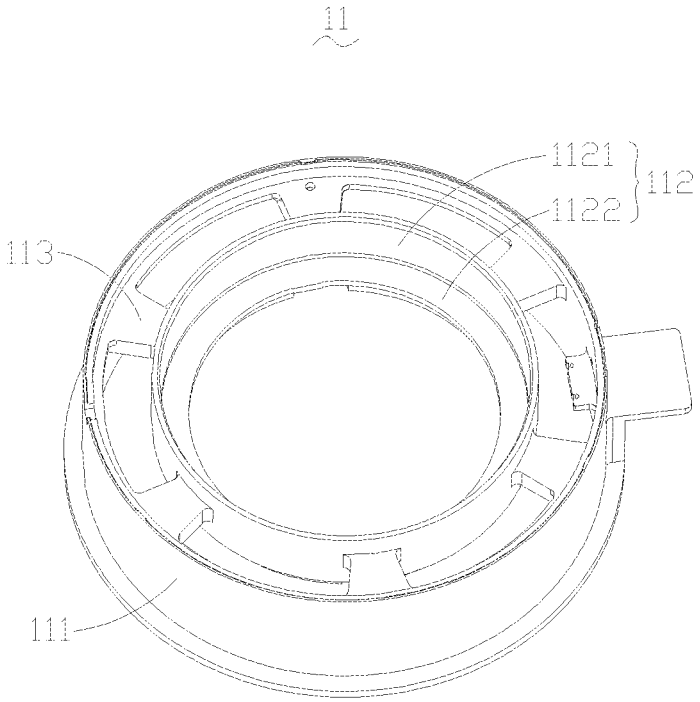
FIG. 10 is a schematic structural diagram of a first shell shown in FIG. 1.
Figure 11:
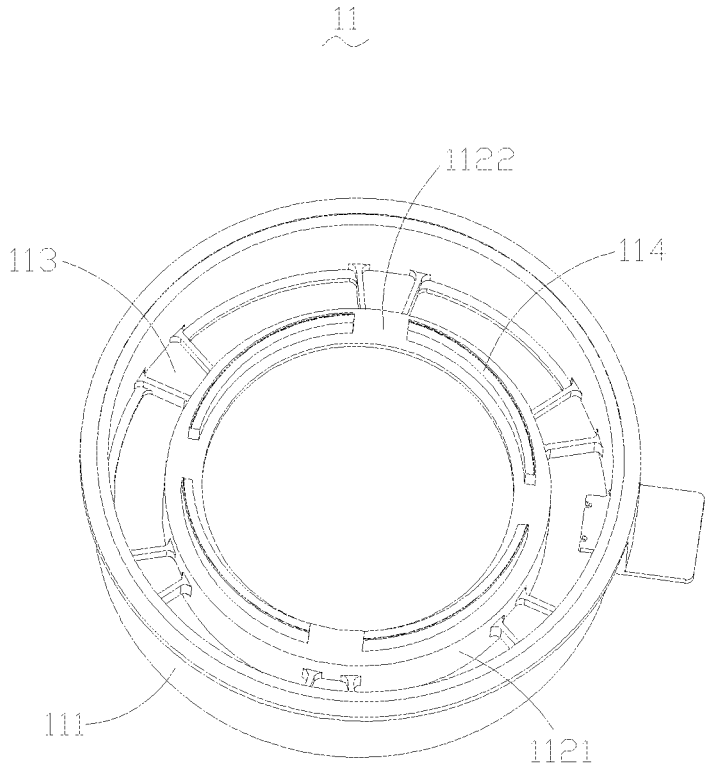
FIG. 11 is a schematic structural diagram of a first shell shown in FIG. 1 from another angle.

100: sound production unit;

1: frame;

- 11: first shell; 111: first shell body;
- 112: first supporting portion; 1121: first supporting wall; 1122: second supporting wall;
- 113: first connecting arm; 114: second supporting portion;
- 12: second shell; 121: second shell body; 1211: air vent; 122: third supporting portion;
- 123: second connecting arm; 124: mounting portion; 1241: extending arm; 1242: mounting lug; 1243: connecting hole;

2: magnetic path system;

- 21: magnet assembly; 211: main magnet; 2111: third channel; 212: auxiliary magnet;
- 213: mounting rack; 2131: mounting rack body; 2132: abutment portion; 2133: receiving chamber;
- 22: first pole core assembly; 221: first main pole core; 2211: third through hole; 222: first auxiliary pole core;
- 23: second pole core assembly; 231: second main pole core; 2311: fourth through hole; 232: second auxiliary pole core;

3: vibration system;
- 31: first diaphragm; 311: first vibration piece; 3111: first through hole; 312: first suspension; 313: second suspension;
- 32: second diaphragm; 321: second vibration piece; 3211: second through hole; 322: third suspension; 323: fourth suspension;
- 33: first voice coil assembly; 331: first voice coil bobbin; 3311: first venting hole;
- 332: first voice coil; 333: first channel;
- 34: second voice coil assembly; 341: second voice coil bobbin; 3411: second venting hole;
- 342: second voice coil; 343: second channel;
- 35: first elastic ring;
- 36: second elastic ring;

4: end cover;
- 41: rear sound chamber.

DETAILED DESCRIPTION OF THE EMBODIMENTS

In order to better understand the technical solutions of the present invention, the embodiments of the present invention are described in detail below in combination with accompanying drawings.

It should be clear that the described embodiments are only a part of the embodiments of the present invention, rather than all of the embodiments. Based on embodiments of the present invention, all other embodiments obtained by those of ordinary skill in the art without creative work shall fall within the scope of protection of the present invention.

The terms used in the embodiments of the present invention are only for the purpose of describing the specific embodiments, and are not intended to limit the present invention. The singular forms of "a", "said", and "the" used in the embodiments of the present invention and the claims are also intended to include plural forms, unless the context clearly indicates other meanings.

It should be understood that the term "and/or" herein is only an association relationship that describes associated objects, and represents that there can be three relationships. For example, A and/or B can represent that: A exists alone, A and B exist simultaneously, and B exists alone. In addition, the character "/" herein generally indicates that the front and back associated objects are in an "or" relationship.

It should be noted that the directional words such as "above", "below", "left", and "right" described in the embodiments of the present invention are described from the angles shown in the drawings, and should not be construed as limiting the embodiments of the present application. In addition, in this context, it should also be understood that when an element is referred to as being "above" or "below" another element, it can not only be directly connected "above" or "below" another element, but also indirectly connected to the "above" or "below" of another element through an intermediate.

An embodiment of the present application provides a sound production unit, including a frame, a magnetic path system, a vibration system, and an end cover. The frame has a receiving space. The magnetic path system is arranged in the receiving space, and a magnetic gap is formed in the magnetic path system. The vibration system includes a first diaphragm and a second diaphragm which are fixedly arranged to two opposite sides of the frame, a first voice coil assembly inserted into the magnetic gap to drive the first diaphragm to vibrate to produce a sound, and a second voice coil assembly inserted into the magnetic gap to drive the second diaphragm to vibrate to produce a sound. The end cover is fixedly arranged on one side of the frame that is provided with the first diaphragm or the second diaphragm. The first diaphragm has a first through hole, and the second diaphragm has a second through hole; the first voice coil assembly has a first channel which extends along a vibrating direction of the first diaphragm or the second diaphragm, and the second voice coil assembly has a second channel which extends along the vibrating direction; the magnetic path system has a third channel which extends along the vibrating direction; and the first through hole, the first channel, the third channel, the second channel, and the second through hole are communicated in sequence to form a sound guide channel; therefore, sound waves produced by the first diaphragm that vibrates air flow to the side with the second diaphragm via the sound guide channel, or sound waves produced by the second diaphragm that vibrates air flow to the side with the second diaphragm via the sound guide channel, so that cophase stacking is performed on the sound waves produced by the first diaphragm that vibrates air and the sound waves produced by the second diaphragm that vibrates air, which can enhance the acoustics effect of the sound production unit.

Referring to FIG. 1, an embodiment of the present application provides a sound production unit 100, including a frame 1, a magnetic path system 2, a vibration system 3, and an end cover 4. The frame 1 has a receiving space (not shown in the figure). The magnetic path system 2 is arranged in the receiving space, and a magnetic gap (not shown in the figure) is formed in the magnetic path system 2. The vibration system 3 includes a first diaphragm 31 and a second diaphragm 32 which are fixedly arranged on two opposite sides of the frame 1, a first voice coil assembly 33 inserted into the magnetic gap to drive the first diaphragm 31 to vibrate to produce a sound, and a second voice coil assembly 34 inserted into the magnetic gap to drive the second diaphragm 32 to vibrate to produce a sound. The end cover 4 is fixedly arranged on one side of the frame 1 that is provided with the first diaphragm 31 or the second diaphragm 32.

The first voice coil assembly 33 has a first channel 333 which extends along a vibrating direction of the first diaphragm 31 or the second diaphragm 32, and the second voice coil assembly 34 has a second channel 343 which extends along the vibrating direction of the first diaphragm 31 or the second diaphragm 32.

Referring to FIG. 1 to FIG. 5, the first voice coil assembly 33 includes a first voice coil bobbin 331, and a first voice coil 332 arranged around an outer periphery of the first voice coil bobbin 331; and the second voice coil assembly 34 includes a second voice coil bobbin 341, and a second voice coil 342 arranged around an outer periphery of the second voice coil bobbin 341. The first channel 333 is arranged in a manner of penetrating through the first voice coil bobbin 331 along the vibrating direction of the first diaphragm 31 or the second diaphragm 32, and the second channel 343 is arranged in a manner of penetrating through the second voice coil bobbin 341 along the vibrating direction of the first diaphragm 31 or the second diaphragm 32.

Specifically, the first voice coil bobbin 331 and/or the second voice coil bobbin 341 are enclosed to form a hollow barrel-shaped structure, so that the first channel 333 which extends along the vibrating direction of the first diaphragm 31 or the second diaphragm 32 is formed in the middle of the first voice coil bobbin 331, and the second channel 343 which extends along the vibrating direction of the first diaphragm 31 or the second diaphragm 32 is formed in the middle of the second voice coil bobbin 341.

A plurality of first venting holes 3311 are formed in a side wall of the first voice coil bobbin 331; a plurality of second venting holes 3411 are formed in a side wall of the second voice coil bobbin 341, so that a space formed by enclosing the first voice coil bobbin 331 and the first voice coil 332 and a space formed by enclosing the second voice coil bobbin 341 and the second voice coil 342 are communicated with the receiving space, so as to maintain an air pressure balance between the first voice coil assembly 33, the second voice coil assembly 34 and the receiving space, thus guaranteeing the working performance of the sound production unit 100.

A projection of the first channel 333 and/or the second channel 343 along the vibrating direction of the first diaphragm 31 or the second diaphragm 32 is, but not limited to, circular, triangular, square, polygonal, or of any other shapes, which is not limited here.

A material of the first voice coil bobbin 331 and/or the second voice coil bobbin 341 includes, but is not limited to, kraft paper, asbestos paper, aluminum, polyimide, glass fiber, and the like, and a material of the first voice coil 332 and/or the second voice coil 342 includes, but is not limited to, a copper wire, an aluminum wire, and the like, which is not limited here.

The first voice coil 332 and the second voice coil 342 are used for receiving an audio current. Since the first voice coil 332 and the second voice coil 342 are inserted into the magnetic gap, the first voice coil 332 and the second voice coil 342 will be subjected to a force, the magnitude of which is in direct proportion to the audio current and the direction of which changes with the audio current, so as to vibrate. The first voice coil 332 drives the first diaphragm 31 to vibrate to produce a sound, and the second voice coil 342 drives the second diaphragm 32 to vibrate to produce a sound.

The direction where the first voice coil assembly 33 drives the first diaphragm 31 to vibrate is opposite to the direction where the second voice coil assembly 34 drives the second diaphragm 32 to vibrate, and driving forces provided to them by the magnetic path system 2 are the same and can counteract the vibration of the entire sound production unit 100 caused by the vibration of the first diaphragm 31 and/or the second diaphragm 32, thus achieving vibration attenuation and improving the acoustic performance and structural stability of the sound production unit 100.

The first diaphragm 31 has a first through hole 3111, and the second diaphragm 32 has a second through hole 3211. Wherein, the first through hole 3111 is communicated with the first channel 333, and the second through hole 3211 is communicated with the second channel 343.

Referring to FIG. 2 to FIG. 7, the first diaphragm 31 includes a first vibration piece 311, a first suspension 312 and a second suspension 313. The first vibration piece 311 is fixedly arranged on the frame 1 through the first suspension 312 and the second suspension 313, and the first through hole 3111 is formed in the first vibration piece 311. The second diaphragm 32 includes a second vibration piece 321, a third suspension 322 and a fourth suspension 323. The second vibration piece 321 is fixedly arranged on the frame 1 through the third suspension 322 and the fourth suspension 323.

Specifically, the first diaphragm 31 and the second diaphragm 32 have the same structures, and are fixedly arranged on two opposite sides of the frame 1 in a mirrored manner. The first suspension 312 and the second suspension 313 can further provide certain compliance for the vibration of the first vibration piece 311, and provide a restoration force after the vibration deformation of the first vibration piece 311. The third suspension 322 and the fourth suspension 323 can further provide certain compliance for the vibration of the second vibration piece 321, and provide a restoration force after the vibration deformation of the second vibration piece 321.

A material of the first suspension 312 and/or the second suspension 313 and/or the third suspension 322 and/or the fourth suspension 323 includes, but is not limited to, paper, cloth, plastic, rubber, and the like, and a material of the first vibration piece 311 and/or the second vibration piece 321 includes, but is not limited to, paper, plastic, metal, carbon fiber, and the like, which are not limited here.

Continuing to refer to FIG. 1 to FIG. 5, the vibrating system 3 further includes a first elastic ring 35 and a second elastic ring 36 which are spaced apart along the vibrating direction; wherein, the first elastic ring 35 is connected between the first voice coil 332 and the frame 1; and the second elastic ring 36 is connected between the second voice coil 342 and the frame 1.

Specifically, an inside edge of the first elastic ring 35 is connected to the first voice coil 332, and an outside edge of the first elastic ring 35 is connected to the frame 1, so as to ensure that the first voice coil 332 does not eccentrically vibrate, but only vibrates along an axial direction of the first voice coil bobbin 331. An inside edge of the second elastic ring 36 is connected to the second voice coil 342, and an outside edge of the second elastic ring 36 is connected to the frame 1, so as to ensure that the second voice coil 342 does not eccentrically vibrate, but only vibrates along an axial direction of the second voice coil bobbin 341, thus finally achieving enhancing the acoustics effect of the sound production unit 100.

A material of the first elastic ring 35 or the second elastic ring 36 includes, but is not limited to, cotton cloth, aramid fiber, plastic, mixture yarn, polyester, and the like, which is not limited here.

The magnetic path system 2 has a third channel 2111 which extends along the vibrating direction of the first diaphragm 31 or the second diaphragm 32, and the third channel 2111 is used for communicating the first channel 333 to the second channel 343.

Referring to FIG. 2 to FIG. 5 and FIG. 8, the magnetic path system 2 includes a magnet assembly 21, and a first pole core assembly 22 and a second pole core assembly 23 which are fixedly arranged on two opposite sides of the magnet assembly 21. By the arrangement of the first pole core assembly 22 and the second pole core assembly 23, the orientation of magnetic lines can be improved. Furthermore, the magnetic lines are more intensive, thus enhancing the intensity of a magnetic field in the magnetic gap and improves the vibration sensitivity of the first diaphragm 31 and the second diaphragm 32, which in turn enhances the acoustics effect of the sound production unit 100.

The magnet assembly 21 includes a main magnet 211, and an auxiliary magnet 212 arranged around an outer periphery of the main magnet 211; and the main magnet 211 and the auxiliary magnet 212 are spaced apart from each other to for the magnetic gap. The third channel 2111 is arranged in a manner of penetrating through the main magnet 211 along the vibrating direction of the first diaphragm 31 or the second diaphragm 32.

The first pole core assembly 22 includes a first main pole core 221 and a first auxiliary pole core 222. The second pole core assembly 23 includes a second main pole core 231 and a second auxiliary pole core 232. The first main pole core 221 and the second main pole core 231 are fixedly arranged on two opposite sides of the main magnet 211 along the vibrating direction of the first diaphragm 31 or the second diaphragm 32. The first auxiliary pole core 222 and the second auxiliary pole core 232 are fixedly arranged on two opposite sides of the auxiliary magnet 212 along the vibrating direction of the first diaphragm 31 or the second diaphragm 32. The first auxiliary pole core 222 is arranged around an outer periphery of the first main pole core 221, and the second auxiliary pole core 232 is arranged around an outer periphery of the second main pole core 231.

The first main pole core 221 is provided, in a penetrating manner along the vibrating direction of the first diaphragm 31 or the second diaphragm 32, with a third through hole 2211 communicated with the first channel 333 and the third channel 2111; and the second main pole core is provided, in a penetrating manner along the vibrating direction of the first diaphragm 31 or the second diaphragm 32, with a fourth through hole 2311 communicated with the second channel 343 and the third channel 2111.

A projection of the third channel 2111 along the vibrating direction of the first diaphragm 31 or the second diaphragm 32 is, but not limited to, circular, triangular, square, polygonal, or of any other shapes. The shape of the third through hole 2211 and the fourth through hole 2311 is matched with the shape of the third channel 2111, which is not limited here.

A material of the main magnet 211 and/or the auxiliary magnet 212 includes, but is not limited to, ferrite, brown neodymium iron boron, strontium magnet, and the like. A material of the first main pole core 221 and/or the second main pole core 231 and/or the first auxiliary pole core 222 and/or the second auxiliary pole core 232 includes, but is not limited to, soft iron, low-carbon steel or any other magnetically permeable materials, which is not limited here.

In some embodiments, the magnetic path system 2 further includes a mounting rack 213 having a receiving chamber 2133, and the main magnet 211 is arranged in the receiving chamber 2133. The auxiliary magnet 212 is arranged around an outer periphery of the mounting rack 213, and the main magnet 211 is connected to the auxiliary magnet 212 through the mounting rack 213.

Referring to FIG. 2 to FIG. 5 and FIG. 9, the magnet assembly 21 further includes a mounting rack 213, and the mounting rack 213 includes a mounting rack body 2131 and an abutment portion 2132.

Wherein, the mounting rack body 2131 has a receiving chamber 2133, and the main magnet 211 is arranged in the receiving chamber 2133. The receiving chamber 2133 has a first opening (not shown in the figure) and a second opening (not shown in the figure) which are oppositely disposed.

Specifically, the first opening faces to the first diaphragm 31, and the second opening faces to the second diaphragm 32. An inner diameter of the first opening is less than an outer diameter of the main magnet 211, and an inner diameter of the second opening is greater than the outer diameter of the main magnet 211, so that the main magnet 211 can be received in the receiving chamber 2133, and the first opening is communicated with the third channel 2111 and the third through hole 2211. The abutment portion 2132 extends from the second opening along a radial direction of the mounting rack body 2131; and the abutment portion 2132 is fixedly connected to one side of the auxiliary magnet 212 facing to the second diaphragm 32.

A material of the mounting rack 213 includes, but is not limited to, plastic, paper, metal, and the like, which is not limited here.

In some embodiments, the frame 1 includes a first shell 11 for fixing the first diaphragm 31 and a second shell 12 for fixing the second diaphragm 32. The first shell 11 is superposed to the second shell 12 along the vibrating direction of the first diaphragm 31 or the second diaphragm 32, and the first shell 11 and the second shell 12 are enclosed jointly to form the receiving space. A supporting portion is arranged in the first shell 11 or the second shell 12; and the magnetic path system 2 is fixedly arranged to the supporting portion.

Referring to FIG. 2 to FIG. 5, FIG. 10, and FIG. 11, the first shell 11 includes a first shell body 111, a first supporting portion 112 arranged on an inside of the first shell body 111, and a plurality of first connecting arms 113 extending from the first shell body 111 to the first supporting portion 112.

The first supporting portion 112 includes a first supporting wall 1121 and a second supporting wall 1122. Wherein, the first supporting wall 1121 extends along the vibrating direction of the first diaphragm 31 or the second diaphragm 32, and the second supporting wall 1122 extends from one side of the first supporting wall 1121 close to the first diaphragm 31 along a direction perpendicular to the vibrating direction of the first diaphragm 31 or the second diaphragm 32, so that the first supporting wall 1121 and the second supporting wall 1122 are enclosed jointly to form the receiving chamber (not shown in the figure), and the magnetic path system 2 is received in the receiving chamber.

One side of the second supporting wall 1122 facing to the first diaphragm 31 extends along a direction close to the first diaphragm 31 to form a plurality of second supporting portions 114, and an outside edge of the first elastic ring 35 is fixedly arranged on the second supporting portion 114.

Referring to FIG. 2 to FIG. 5 and FIG. 12, the second shell 12 includes a second shell body 121, a third supporting portion 122 arranged on an inside of the second shell body 121, and a plurality of second connecting arms 123 extending from the second shell body 121 to the third supporting portion 122. Specifically, an outside of the second elastic ring 36 is fixedly arranged on a side wall of the third supporting portion 122 facing away from the second diaphragm 32.

A plurality of air vents 1211 are provided on a circumferential side wall of the second shell body 121 to communicate the receiving space with an external environment, thereby maintaining an air pressure balance between the receiving space and the external environment, and ensuring the working performance of the sound production unit 100.

It can be understood that the third supporting portion 122 may also be provided with a receiving chamber and the magnetic path system 2 is received in the receiving chamber formed on the third supporting portion 122.

A side wall of the first shell 11 and/or a side wall of the second shell 12 is provided with at least one mounting portion 124, and the mounting portion 124 is connected to an external shell.

Figure 12:
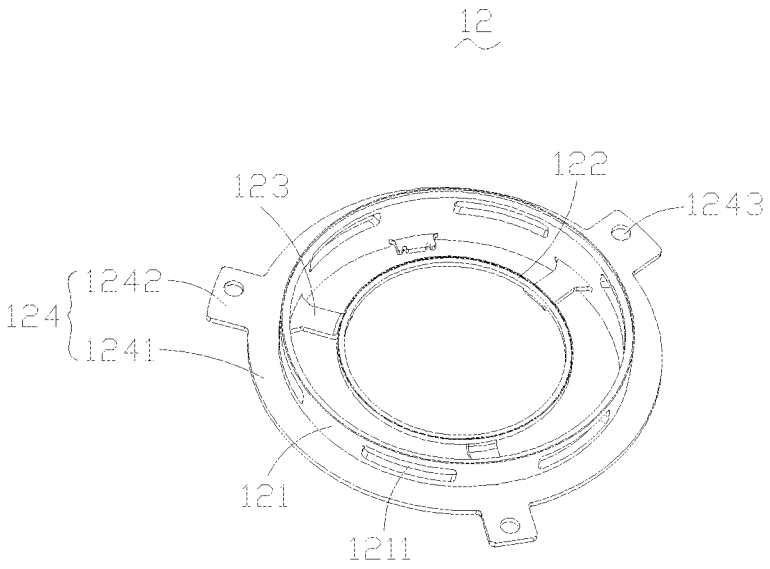
FIG. 12 is a schematic structural diagram of a second shell shown in FIG. 1.

Continuing to refer to FIG. 12, the mounting portion 124 extends from the side wall of the second shell 12 in a direction away from the second shell 12. The mounting portion 124 includes an extending arm 1241 and a plurality of mounting lugs 1242. Wherein, the extending arm 1241 extends from the side wall of the second shell 12 in the direction away from the second shell 12, and the mounting lugs 1242 are spaced apart from each other and extend, along the direction away from the second shell 12, from end portions of the extending arm 1241 away from the second shell 12.

Specifically, the mounting lugs 1242 are provided with connecting holes 1243, and the mounting lugs 1242 are inserted into the connecting holes 1243 through fasteners for connection to the external shell. The external shell may be a shell of a speaker.

It can be understood that the mounting portion 124 may also extend from a side wall of the first shell 11 along a direction away from the first shell 11. The first shell 11 and/or the second shell 12 may also be connected to the external shell by welding, integral molding, snap-fit, etc., which is not limited here.

A material of the first shell 11 and/or the second shell 12 include, but is not limited to, plastic, aluminum alloy, stainless steel, aluminum-magnesium alloy, and the like. The first shell 11 and the second shell 12 can be fixedly connected by welding, integral molding, threaded fit, snap-fit, etc., which is not limited here.

The end cover 4 is fixedly arranged on the side of the frame 1 that is provided with the first diaphragm 31 or the second diaphragm 32, whereby a rear sound chamber 41 is formed between the end cover 4 and the first diaphragm 31 or the second diaphragm 32.

Continuing to refer to FIG. 2 to FIG. 5, an outside edge of the first suspension 312 is connected to the first shell body 111, and an inside edge of the first suspension 312 is connected to an outside edge of the first vibration piece 311; an outside edge of the second suspension 313 is connected to an inside edge of the first vibration piece 311; and an inside edge of the second suspension 313 is connected to an end portion of the first voice coil bobbin 331 close to the first vibration piece 311. An end portion of the first voice coil bobbin 331 away from the first vibration piece 311 is connected to the first main pole core 221; the first voice coil 332 is arranged around an outer periphery of the first voice coil bobbin 331; and at least part of the first voice coil 332 is inserted into the magnetic gap. An inside edge of the first elastic ring 35 is connected with a side wall of the first voice coil 332, and an outside edge of the first elastic ring 35 is connected with the second supporting portion 114.

An outside edge of the third suspension 322 is connected with the second shell body 121; an inside edge of the third suspension 322 is connected with an outside edge of the second vibration piece 321; an outside edge of the fourth suspension 323 is connected with an inside edge of the second vibration piece 321; an inside edge of the fourth ring 323 is connected to an end portion of the second voice coil bobbin 341 close to the second vibration piece 321. An end portion of the second voice coil bobbin 341 away from the second vibration piece 321 is connected to the second main pole core 231; the second voice coil 342 is arranged around an outer periphery of the second voice coil bobbin 341; and at least part of the second voice coil 342 is inserted into the magnetic gap. An inside edge of the second elastic ring 36 is connected with a side wall of the second voice coil 342, and an outside edge of the second elastic ring 36 is connected with the third supporting portion 122.

The end cover 4 is fixedly arranged on the side of the frame 1 that is provided with the second diaphragm 32, and a rear sound chamber 41 is formed between the second diaphragm 32 and the end cover 4. When the second voice coil 342 drives the second diaphragm 32 to vibrate to produce a sound, sound waves produced by the second diaphragm 32 that vibrates air in the rear sound chamber 41 can flow from the second through hole 3211, the second channel 343, the third channel 2111, the first channel 333, and the first through hole 3111 in sequence to the side with the first diaphragm 31, so that cophase stacking can be performed on the sound waves produced by the first diaphragm 31 that vibrates the air and the sound waves produced by the second diaphragm 32 that vibrates the air, thus can enhancing the acoustics effect of the speaker; furthermore, an effective vibration area of dual diaphragms is achieved; the vibration loudness of the sound production unit 100 is increased to a larger extent; and the acoustic performance is improved.

It can be understood that the end cover 4 can also be fixedly arranged on the side of the frame 1 that is provided with the first diaphragm 31, and a rear sound chamber 41 is formed between the first diaphragm 31 and the end cover 4. When the first voice coil 332 drives the first diaphragm 31 to vibrate to produce a sound, the sound waves produced by the first diaphragm 31 that vibrates air in the rear sound chamber 41 can flow from the first through hole 3111, the first channel 333, the third channel 2111, the second channel 343, and the second through hole 3211 in sequence to the side with the second diaphragm 32.

A material of the end cover 4 includes, but is not limited to, rubber, plastic, aluminum alloy, stainless steel, aluminum-magnesium alloy, and the like. The end cover 4 and the first shell 11 or the second shell 12 can be fixedly connected by welding, integral molding, threaded fit, snap-fit, etc., which is not limited here.

An embodiment of the present application further provides a speaker, including the aforementioned sound production unit 100. The speaker can be applied to various electronic devices such as a vehicular audio system, a notebook computer, a smart phone, a tablet computer, a virtual reality helmet, a smart bracelet and other mobile electronic terminal devices, a smart screen, an intelligent toy, and an intelligent audio billboard.

The vehicular audio system is taken as an example. The speaker can be mounted in a door of an automobile, a hat rack, and other positions. Since the sound production unit 100 can counteract the vibration of the entire sound production unit 100 or the speaker caused by the vibration of the first diaphragm 31 and/or the second diaphragm 32 to achieve vibration attenuation, the influence of a mounting space in the automobile on the acoustic performance of the speaker can be reduced, thus providing a clean bass effect.

Compared with the related art, according to a sound production unit 100 and a speaker provided in the embodiments of the present application, the sound production unit 100 includes a first diaphragm 31 and a second diaphragm 32 which are fixedly arranged on two opposite sides of the frame 1. Under the action of the magnetic path system 2, the direction where the first voice coil assembly 33 drives the first diaphragm 31 to vibrate is opposite to the direction where the second voice coil assembly 34 drives the second diaphragm 32 to vibrate, and driving forces to them provided by the magnetic path system 2 are the same, and can counteract the vibration of the entire sound production unit 100 or speaker due to the vibration of the first diaphragm 31 and/or the second diaphragm 32, thus achieving vibration attenuation, improving the acoustic performance and structural stability of the sound production unit 100 and ensuring the working performance of the speaker.

In addition, the end cover 4 is fixedly arranged on the side of the frame 1 that is provided with the first diaphragm 31 or the second diaphragm 32; the first diaphragm 31 has the first through hole 3111; the second diaphragm 32 has the second through hole 3211; the first voice coil assembly 33 has the first channel 333; the second voice coil assembly 34 has the second channel 343; the magnetic path system 2 has the third channel 2111; the first through hole 3111, the first channel 333, the third channel 2111, the second channel 343, and the second through hole 3211 are communicated in sequence to form a sound guide channel; therefore, sound waves produced by the first diaphragm 31 that vibrates air flow to the side with the second diaphragm 32 via the sound guide channel, or sound waves produced by the second diaphragm 32 that vibrates air flow to the side with the first diaphragm 31 via the sound guide channel, so that cophase stacking is performed on the sound waves produced by the first diaphragm 31 that vibrates air and the sound waves produced by the second diaphragm 32 that vibrates air, which can enhance the acoustics effect of the speaker.

The above is only the preferred embodiments of the present invention, and is not intended to limit the present invention. Any modifications, equivalent replacements and improvements that are made within the spirit and principle of the present invention shall fall within the protection scope of the present invention.

What is claimed is:

1. A sound production unit, comprising:

a frame, wherein the frame has a receiving space;

a magnetic path system, wherein the magnetic path system is arranged in the receiving space, and a magnetic gap is formed in the magnetic path system;

a vibration system, wherein the vibration system comprises a first diaphragm and a second diaphragm which are fixedly arranged on two opposite sides of the frame, a first voice coil assembly inserted into the magnetic gap to drive the first diaphragm to vibrate to produce a sound, and a second voice coil assembly inserted into the magnetic gap to drive the second diaphragm to vibrate to produce a sound; and an end cover, wherein the end cover is fixedly arranged on one side of the frame that is provided with the first diaphragm or the second diaphragm;

wherein the first diaphragm has a first through hole, and the second diaphragm has a second through hole; the first voice coil assembly has a first channel which extends along a vibrating direction of the first diaphragm or the second diaphragm, and the second voice coil assembly has a second channel which extends along the vibrating direction; the magnetic path system has a third channel which extends along the vibrating direction; and the first through hole, the first channel, the third channel, the second channel, and the second through hole are communicated in sequence.

2. The sound production unit of claim 1, wherein the magnetic path system comprises a main magnet, and an auxiliary magnet arranged around an outer periphery of the main magnet; the main magnet and the auxiliary magnet are spaced apart from each other to form the magnetic gap;

the third channel is arranged in a manner of penetrating through the main magnet along the vibrating direction.

3. The sound production unit of claim 2, wherein the magnetic path system further comprises a first main pole core and a second main pole core which are fixedly arranged on two opposite sides, along the vibrating direction, of the main magnet, and a first auxiliary pole core and a second auxiliary pole core which are fixedly arranged on two opposite sides, along the vibrating direction, of the auxiliary magnet; the first auxiliary pole core is arranged around an outer periphery of the first main pole core; the second auxiliary pole core is arranged around an outer periphery of the first main pole core;

the first main pole core is provided, in a penetrating manner along the vibrating direction, with a third through hole communicated to the first channel and the third channel; and the second main pole core is provided, in a penetrating manner along the vibrating direction, with a fourth through hole communicated with the second channel and the third channel.

4. The sound production unit of claim 3, wherein the first voice coil assembly comprises a first voice coil bobbin fixedly arranged between the first diaphragm and the first main pole core, and a first voice coil arranged around an outer periphery of the first voice coil bobbin; the first channel is arranged in a manner of penetrating through the first voice coil bobbin along the vibrating direction;

the second voice coil assembly comprises a second voice coil bobbin fixedly arranged between the second diaphragm and the second main pole core, and a second voice coil arranged around an outer periphery of the second voice coil bobbin; the second channel is arranged in a manner of penetrating through the second voice coil bobbin along the vibrating direction;

at least part of the first voice coil and at least part of the second voice coil are inserted into the magnetic gap.

5. The sound production unit of claim 3, wherein the magnetic path system further comprises a mounting rack; the mounting rack comprises a mounting rack body and an abutment portion; the mounting rack body has a receiving chamber; the main magnet is arranged in the receiving chamber; the receiving chamber has a first opening and a second opening which are oppositely arranged;

the first opening faces to the first diaphragm; the second opening faces to the second diaphragm; an inner diameter of the first opening is less than an outer diameter of the main magnet; an inner diameter of the second opening is greater than the outer diameter of the main magnet;

the abutment portion extends from the second opening along a radial direction of the mounting rack body; and the abutment portion is fixedly connected to one side of the auxiliary magnet facing to the second diaphragm.

6. The sound production unit of claim 4, wherein the vibrating system further comprises a first elastic ring and a second elastic ring which are spaced apart along the vibrating direction; the first elastic ring is connected between the first voice coil and the frame; and the second elastic ring is connected between the second voice coil and the frame.

7. The sound production unit of claim 4, wherein the first diaphragm comprises a first vibration piece, a first suspension and a second suspension; the first through hole is formed in the first vibration piece; the first suspension is connected between an outside edge of the first vibration piece and the frame; the second suspension is connected between an inside edge of the first vibration piece and the first voice coil bobbin;

and/or, the second diaphragm comprises a second vibration piece, a third suspension and a fourth suspension; the second through hole is formed in the second vibration piece; the third suspension is connected between an outside edge of the second vibration piece and the frame; and the fourth suspension is connected between an inside edge of the second vibration piece and the second voice coil bobbin.

8. The sound production unit of claim 1, wherein the frame comprises a first shell for fixing the first diaphragm and a second shell for fixing the second diaphragm; the first shell is superposed to the second shell along the vibrating direction;

a supporting portion is arranged in the first shell or the second shell; and the magnetic path system is fixedly arranged to the supporting portion.

9. The sound production unit of claim 8, wherein a side wall of the first shell and/or a side wall of the second shell is provided with at least one mounting portion; and the mounting portion is connected to an external shell.

10. A speaker, comprising the sound production unit of claim 1.

* * * * *